US006639142B2

(12) United States Patent
Takahashi

(10) Patent No.: US 6,639,142 B2
(45) Date of Patent: Oct. 28, 2003

(54) APPARATUS AND METHOD FOR PROCESSING WAVEFORM DATA TO CONSTITUTE MUSICAL PERFORMANCE DATA STRING

(75) Inventor: Makoto Takahashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/052,835

(22) Filed: Jan. 17, 2002

(65) Prior Publication Data

US 2002/0100359 A1 Aug. 1, 2002

(30) Foreign Application Priority Data

Jan. 17, 2001 (JP) ..... 2001-008927

(51) Int. Cl.[7] ..... G04B 13/00; G10H 7/00
(52) U.S. Cl. ..... 84/609; 84/603; 84/649
(58) Field of Search ..... 84/600–606, 609–612, 84/622, 649–652, 659

(56) References Cited

U.S. PATENT DOCUMENTS 5,382,749 A * 1/1995 Fujita et al. ..... 84/603
5,792,971 A * 8/1998 Timis et al. ..... 84/609
5,973,255 A * 10/1999 Tanji ..... 84/604
6,218,604 B1 * 4/2001 Yamamoto ..... 84/604
6,281,423 B1 * 8/2001 Shimizu et al. ..... 84/622
6,326,537 B1 * 12/2001 Tamura ..... 84/603

* cited by examiner

*Primary Examiner*—Marlon T. Fletcher
(74) *Attorney, Agent, or Firm*—Morrison & Foerster LLP

(57) ABSTRACT

A waveform data processing apparatus includes a waveform data recording device which records waveform data representing waveform samples, and a waveform events track recording device which records, on a waveform events track defining a musical progression with respect to time, waveform event data representing events for employing waveform samples to constitute a musical performance as the alignment of the waveform samples. The waveform event data contains trigger signals at time points where respectively corresponding ones of the waveform samples are to be employed along the musical progression on the waveform events track. As the waveform events track is played back, the respective trigger signals serve to trigger the playback of the corresponding waveform samples to constitute a musical performance with such waveform samples. Each of the waveform samples represented by the waveform data defines a musical tone having a build-up point. The waveform data may be split at a build-up point to form waveform sub-samples, while the waveform event data will further contain trigger signals corresponding to the split sub-samples. Other than splitting, further editions are available such as deletion, insertion, copying and pasting of a part or parts of the waveform data.

18 Claims, 8 Drawing Sheets

*Fig. 1* Example of Waveform Events Track of Musical Performance Data

*Fig.2* Real-Time Recording Process

*Fig.3* Waveform Edition Process

*Fig.4* Splitting

*Fig.5* Track Copy, Song Copy

*Fig.6* Partial Deletion

*Fig.8* Musical Performance Data
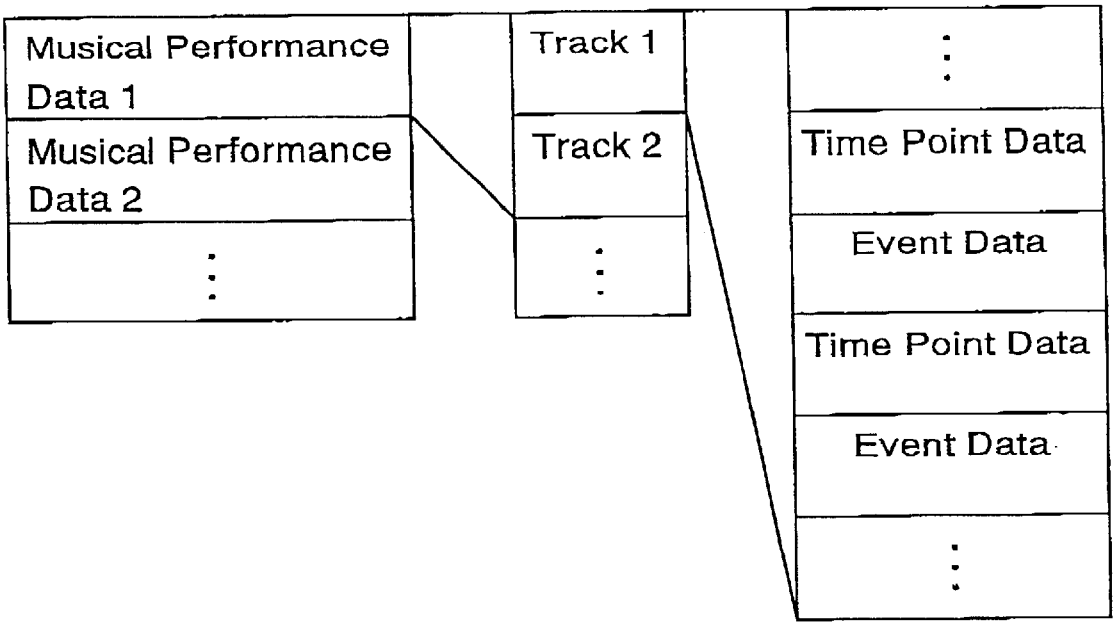
*Fig.9* Waveform Sample Data
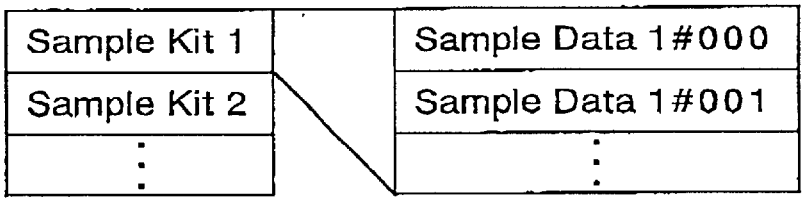

APPARATUS AND METHOD FOR PROCESSING WAVEFORM DATA TO CONSTITUTE MUSICAL PERFORMANCE DATA STRING

BACKGROUND OF THE INVENTION

1. Field of the Invention

The present invention relates to a waveform data processing apparatus and method, and a machine readable medium containing program instructions for realizing such an apparatus and a method using a computer system, and more particularly to an apparatus and a method capable of constituting a musical performance data string containing waveform event data which represent events for employing waveform samples. As the waveform event data is played back, each of the events triggers the playback of the corresponding waveform sample so that an alignment of the played-back waveform samples forms a musical performance.

2. Description of the Prior Art

In the field of electronic musical instruments and computer music, there are known in the art such an apparatus as a sampler which records waveform data from tones or voices actually produced in the air or in the electronic circuit by various musical apparatuses or natural sound sources. In the known sampler, waveform data pieces obtained by sampling actually produced tones or sounds are recorded and assigned to the controls or manipulating devices for playing music of the apparatus such as keys in a keyboard and beating pads and ten played back according to the manipulation of the control devices for playing music as a real-time music performance, or the waveform data pieces are correlated to the note event codes in a musical permanence data string (automatic musical performance data) for a sequencer (automatic music performing apparatus) and then are played back automatically.

However, in the case where the waveform data representing waveform samples are used for an automatic music performance, the waveform data are recorded beforehand, and then a musical performance data string is constituted by locating note events (as trigger signals) at positions along a music progression at which the respective waveform samples are to be played back. In this connection, when the waveform samples are imputted and recorded in real time by manipulating the input device in tempo with a metronome clicking or a pre-recorded musical performance being played back, the waveform samples themselves cannot be recorded in the form of waveform data for an automatic music performance.

SUMMARY OF THE INVENTION

It is, therefore, a primary object of the present invention to provide a novel type of waveform data processing apparatus and method, and a machine readable medium containing a program therefor capable of constituting a musical performance data string in association with waveform data representing waveform samples which may be easily edited and is convenient for use in an automatic musical performance apparatus.

According to the present invention, the object is accomplished by providing a waveform data processing apparatus comprising: a waveform data recording device which records waveform data representing waveform samples; and a waveform events track recording device which record, on a waveform events track defining a musical progression with respect to time, waveform event data representing events for employing waveform samples to constitute a musical performance; wherein the waveform event data includes trigger signals at time points where respectively corresponding ones of the waveform samples are to be employed along the musical progression on the waveform events track for constituting the musical performance, and wherein the trigger signals serve to trigger the playback of the waveform samples recorded in the waveform recording device in accordance with reading out the waveform events tracks.

According to the present invention, the object is further accomplished by providing a waveform data processing apparatus comprising: a waveform data recording device which records waveform data representing waveform samples, each having a length and defining at least one musical tones, each tone having a build-up point; a waveform events track recording device which records, on a waveform events track defining a musical progression with respect to time, waveform event data representing events for employing the waveform samples to constitute a musical performance; and a waveform data splitting device which detect at least one of the build-up points and splits the waveform data at the detected build-up point into waveform sub-samples; wherein the waveform event data includes trigger signals at time points where respectively corresponding ones of the waveform samples and sub-samples are to be employed along the musical progression on the waveform events track for constituting the musical performance, and wherein the trigger signals serving to trigger the playback of the waveform samples and sub-samples recorded in the waveform recording device in accordance with reading out the waveform events track.

According to an aspect of the present invention, a waveform data processing apparatus may further comprise a data edition device which edits the trigger signals in the waveform event data correspondingly with the waveform data in response to an edit instruction for the waveform event track.

According to the present invention, the object is sill further accomplished by providing a method for processing a waveform data comprising: a step of recording waveform data representing waveform samples; and a step of recording, on a waveform events track defining a musical progression with respect to time, waveform event data representing events for employing waveform samples to constitute a musical performance; wherein the waveform event data includes trigger signals at time points where respectively corresponding ones of the waveform samples are to be employed along the musical progression on the waveform events track for constituting the musical performance, and wherein the trigger signals serve to trigger the playback of the waveform samples recorded in the waveform recording device in accordance with reading out the waveform events track.

According to the present invention, the object is still further accomplished by providing a method for processing a waveform data comprising a step of recording a step of recording waveform data representing waveform samples; each having a length and defining at least one musical tones, each tone having a build-up point; a step of recording, on a waveform events track defining a musical progression with respect to time, waveform event data representing events for employing the waveform samples to constitute a musical performance; a step of detecting at least one of the build-up points; and a step of splitting the waveform data at the detected build-up point into waveform sub-samples; wherein the waveform event data includes trigger signals at the points where respectively corresponding ones of the waveform samples and sub-samples are to be employed along the musical progression on the waveform events track for constituting the musical performance, and wherein the trigger signals serve to trigger the playback of the waveform samples and sub-samples recorded in the waveform recording device in accordance with reading out the waveform events track.

According to a further aspect of the present invention, a method for processing a waveform data may further comprise a step of editing the trigger signals in the waveform event data correspondingly with the waveform data in response to an edit instruction for the waveform event track.

According to the present invention the object is still further accomplished by providing a machine readable medium for use in a waveform data processing apparatus comprising a computer, the medium containing program instructions executable by the computer for executing: a process of recording waveform data representing waveform samples; and a process of recording, on a waveform events track defining a musical progression with respect to time, waveform event data representing events for employing waveform samples to constitute a musical performance, wherein the waveform event data includes trigger signals at time points where respectively corresponding ones of the waveform samples are to be employed along the musical progression on the waveform events track for constituting the musical performance, and wherein the trigger signals serve to trigger the playback of the waveform samples recorded in the waveform recording device in accordance with reading out the waveform events track.

As will be apparent from the description herein later, some of the structural element devices of the present invention are configured by a computer system performing the assigned functions according to the associated programs. They may of course be hardware structured discrete devices. Therefore, a hardware-structured device performing a certain function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 8 is a chart showing the data format of the musical performance data in an embodiment of the present invention; and FIG. 9 is a chart showing the data format of the waveform sample data in an embodiment of the present invention.

DESCRIPTION OF THE PREFERRED EMBODIMENTS

Figure 7:
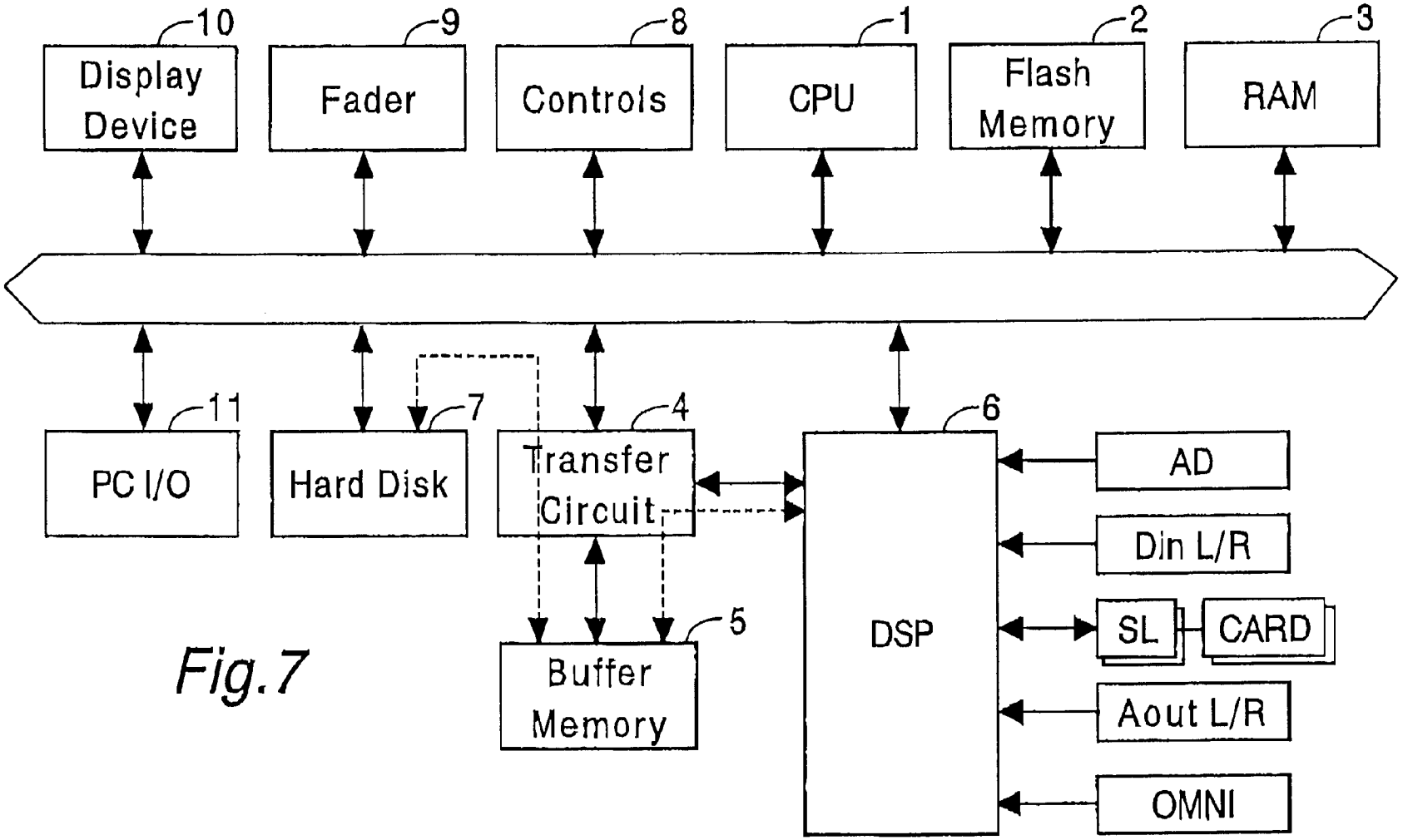
FIG. 7 is a block diagram showing a digital mixing recorder (hard disk recorder) in an embodiment of the present invention.

Illustrated in FIG. 7 is a block diagram showing a digital mixing recorder (hard disk recorder) configured as a waveform data processing apparatus of the present invention. The hard disk recorder comprises a CPU 1, a flash memory 2, a RAM 3, a transfer circuit 4, a buffer memory 5, a DSP (digital signal processor) 6, a hard disk 7, controls (manipulating devices) 8, a fader (volume controls in a signal mixer unit) 9, a display device 10 and a PC in/out interface 11.

The CPU 1 controls the overall operation of the apparatus according to the program stored in tile flash memory 2 and using working areas in the RAM 3. More specifically, the CPU 1 outputs instructions to the transfer circuit 4 and the DSP 6 to manage the recording and reading of the musical performance data into and from the hard disk 7, the recording, reading and mixing of the waveform data representing waveform samples. The CPU 1 also controls the operation of editing the musical performance data and the waveform data based on the control information from the control devices 8 and the fader 9. The CPU 1 further controls operation of motors included in a motor-driven fader 9 in the case of a motor-driven fader 9, and controls the operation of the display device 10. The CPU 1 also controls the communication with other computers via the PC in/out interface 11 to output or input various data including the musical performance data. The CPU 1 further controls the apparatus to play back the musical performance stored in the hard disk 7 or in the RAM 3 at the time of automatic performance or at the time of recording waveform data in real time.

To the DSP 6 are connected an analog input interface AD containing an analog/digital converter for converting the input audio signals to digital signals, a digital input interface Din L/R for inputting digital signals, an input/output slot SL available for connecting an option card CARD such as an analog/digital converting card, a digital/analog converting card and a digital I/O card, an analog output interface Aout L/R containing a digital/analog converter for converting digital signals to analog signals before outputting therefrom, and a multi-purpose analog output interface OMNI to be used for various purposes and also containing a digital/analog converter for converting digital signals to analog signals before outputting therefrom respectively.

The DSP 6 performs, in every predetermined sampling period, various signal processing according to the instructions from the CPU 1, including the processing or the selective mixing of a plurality of digital signals inputted from the respective input interfaces and the transfer circuit 4, and outputs the proccessed digital signals to the respectively corresponding outputs and to the transfer circuit 4. These digital signals will be referred to as sample data, waveform data, waveform sample data or the like in the following description.

The transfer circuit 4 transfers data between the hard disk 7 and the buffer memory 5, and between the buffer memory 5 and the DSP 6 in accordance with the instructions from the CPU 1. For example, in the case of recording waveform sample data representing waveform samples, the transfer circuit 4 receives the data of a sampled instantaneous value from the DSP 6 at each sampling period and writes the same into the buffer memory 5. When a number of sampled values have been written in the buffer memory 5 to the amount of one cluster, the values will be transferred to the storage region of the corresponding track of the hard disk 7. During the data transfer to the hard disk 7, the transfer circuit 4 keeps on receiving the data from the DSP 6. Thus, the waveform data of waveform samples are stored in the hard disk 7.

And in the case of playing back the recorded waveform data, the transfer circuit 4 reads out the sampled value data pieces of the designated waveform data from the hard disk cluster by cluster to write into the buffer memory 5, and reads out data of one sampled value at a time from the buffer memory 5 in each sampling period and transfers the same to the DSP 6. If the size of the waveform data of the designated waveform samples is larger than one cluster, the data transfer will be conducted cluster by cluster, namely, the data in the amount of a first cluster is first transferred from the hard disk 7 to the buffer memory 5, and thereafter when the available area of the buffer memory amounts to one cluster (the data of that area have been already played back), the remaining data in the amount of a second cluster is the transferred from the hard disk 7 to the buffer memory 5, and so forth.

FIG. 8 shows the data format of the musical performance data in an embodiment of the present invention. Each of the musical performance data set is comprised of a plurality of tracks 1, 2, and so forth. Each of the tracks is either a note track containing usual MIDI note data pieces or a waveform event track for triggering playback of the waveform data representing waveform samples, and either track contains (stores) a number of pairs of time point data piece and event data piece recorded in the order of time progression. The time point data defines the time point at which the event data in the pair is to be read out (e.g. in the case of note-on event, the time point of starting tone generation), and is expressed in terms of the clock count from the top end of the music performance. The event data includes a program designation ever note-on events and note-off events. The note-on event and the note-off event in the waveform event track serves as trigger signals for instructing the tone generation start or the tone generation end of the waveform data as designated by the program designation. In this specification, the note-on event and the note-off event will be simply referred to as a note event, where no distinction between the note-on and the note-off is necessary.

FIG. 9 shows the data format of the waveform sample data in an embodiment of the present invention. The hard disk 7 is available for recording the waveform data of a plurality of waveform samples which may be named sample kit 1, sample kit 2, and so forth obtained by sampling the actually produced tones or sounds. A sample kit is an aggregate of sample data blocks representing respective waveform samples. Each sample kit is designated by the event data of program designation in the above-mentioned waveform event track. In each sample kit, waveform data of a plurality of waveform samples may be recorded with identification names such as a sample data block 1#000, a sample data block 1#001, . . . , 1#0127 corresponding to a plurality of note numbers 000, 001, . . . , 0127 (note C(−1), note C#(−1), . . . , note G9:8.176 Hz, 8.662 Hz, . . . , 12543.854 Hz). It should be understood, however, that the correspondence to the note numbers does not necessarily mean that waveform samples have tone pitches, but simply serves to distinguish one sample from another. Basically, one recording of a waveform sample creates a waveform data block of one waveform sample, but such a waveform data block may be split into several data sub-blocks and named differently by means of the splitting operation in the edit function as will be described hereinafter.

Figure 2:
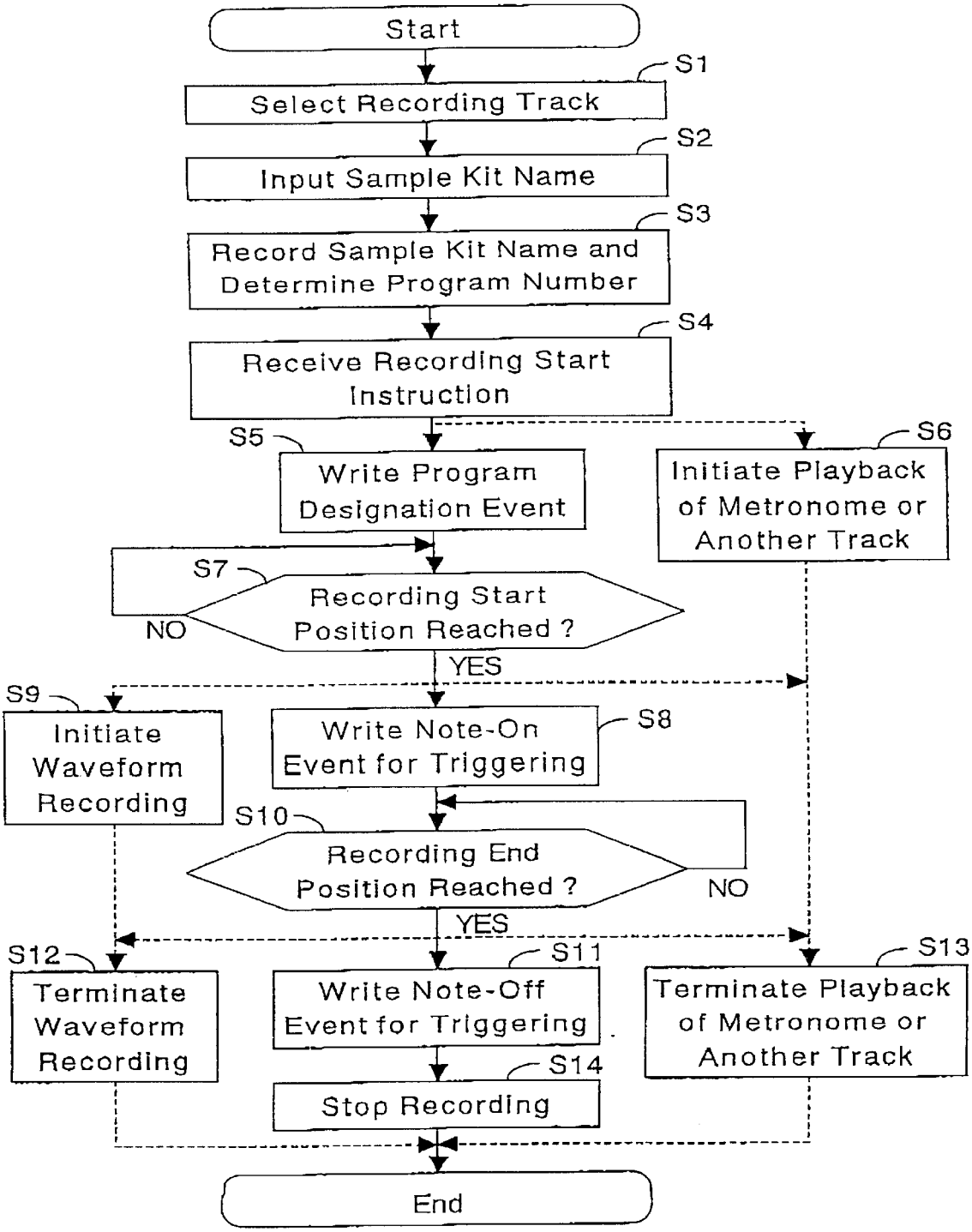
FIG. 2 is a flow chart showing the real-time recording process in an embodiment of the present invention.

FIG. 2 shows a flow chart of the real-time recording process in an embodiment of the present invention. While the embodiment concurrently conducts the processing of writing note-on events as trigger signals in the waveform event track the processing of writing waveform samples (sampler function) and the processing of playing back the metronome clicking or the musical performance data by means of interrupt operation, FIG. 2 shows the flows for the portion of the waveform sample data recording routine and the metronome (etc.) playback routine in dotted line.

As the user designates the metronome tempo and a musical performance data set among those previously recorded in the apparatus and places the preparatory setting for operation, the process for real-time recording will start. The first step S1 selects a track for recording waveform events. Then, the next step S2 is for inputting the name of the sample kit to be recorded on the selected track. A step S3 records the sample kit name and determines the program number. Then, in a step S4, the user instructs the start of recording by manipulating a start switch or some like control. Upon detection of the start instruction, a step S5 writes an event of program designation (the name of the sample kit) on to the designated waveform event track in terms of the program number determined at the step S3. On the other hand, a step S6 initiates the playback of the metronome clicking or the musical performance recorded on another track.

Then, a step S7 is to stand by until the track pointer comes to the position (time point) for starting the recording. For the detection of the recording start position, an available method may be a method of detecting the previously set recording start position, a method of detecting an inputted designation from a predetermined manipulating control in real time, or a method of detecting from the waveform data signal being inputted. As the recording start position is reached, the process flow moves to a step S8 to write, on the designated waveform events track, a note-on event for triggering and its time point, while a step S9 initiates the waveform data recording (i.e. the loading of waveform sample data onto the hard disk 7).

A step S10 then stands by the track pointer comes to the position (time point) for ending the recording. Also for the detection of the recording end position, an available method may be a method of detecting the previously set recording end position, a method of detecting an inputted designation from a predetermined manipulating control in real time, or a method of detecting from the waveform data signal being inputted. As the recording end position is reached, the process flow moves to a step S11 to write, on the designated waveform event track, a note-off event for triggering and its time point, while a step S12 terminates the waveform data recording (i.e. the loading of waveform sample data the hard disk 7) and a step S13 terminates the playback of the metronome clicking or another musical performance track. And finally, a step S14 conducts processing for stopping the recording and ends the process routine of the real-time recording.

Figure 1:
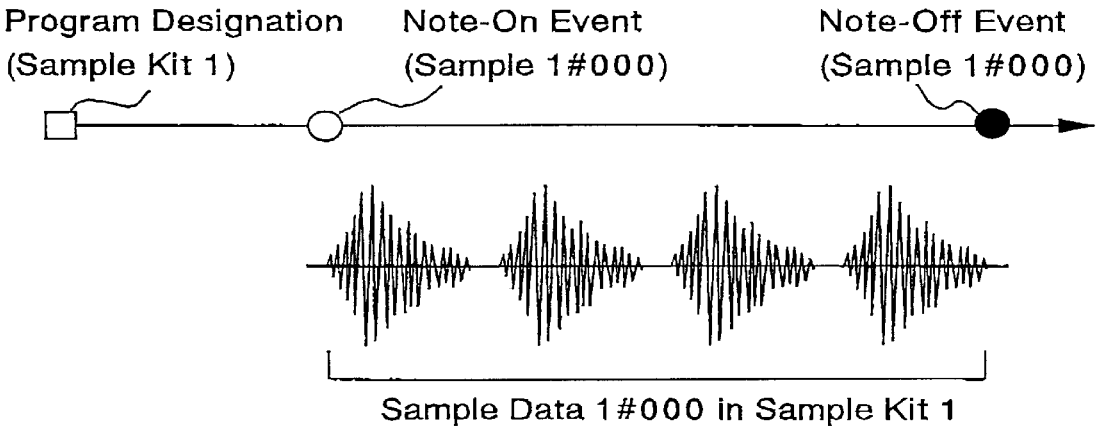
FIG. 1 is a chart showing an example of a waveform events track of the musical performance data together with the waveform samples represented by waveform data recorded in association with the waveform events track according to the present invention.

FIG. 1 shows, as a schematic depiction, an example of a waveform events track of the musical performance data together with waveform samples represented by waveform data recorded in association with the waveform events track according to the present invention. In the Figure, a hollow square indicates a program designation event on the waveform events track, a hollow circle indicates a note-on event and a solid circle indicates a note-off event. The like marks will be used to indicate the like events also in other Figures. According to the above-explained processing, when waveform samples (of a sample kit) are recorded in association with a certain waveform events track waveform sample data representing the waveform samples are recorded in the allotted storage area, a note-on event and a note-off even are recorded on the waveform events track at the time points corresponding to the front end and the rear end of the above-recorded waveform sample data block for triggering start and stop of the waveform sample, respectively. The note-off event may not necessarily be recorded. The program designation event identifying the sample kit (in FIG. 1, sample kit 1) is recorded at a position prior to the first trigger event of the waveform events track. The position may be at the very top of the tract, or immediately before the trigger event, or in-between. The sample kit name may be given arbitrarily.

In the example of FIG. 1 the waveform sample data blocks (only one block is shown in the Figure, though) are identified (named) by using the identification for the notes, i.e. the note numbers. The shown waveform sample data block is named "000" corresponding to the note number "000" for note C(−1), and therefore the first-named waveform sample data block of sample kit 1 is given an identification name of "1#000". Thus, the event data to be recorded on the waveform events track is the note number "000" for triggering the sample data 1#000. The correspondence between the sample data block numbers and the note numbers may be fixedly determined, or may be flexibly determinable by the user.

The positions of the note-on event and the note-off event on the waveform events track to trigger the start and the end of each waveform sample data block are designated by several ways, for example, by the following three ways. The first one is that the time span for recording the waveform sample is designated previously, such as in terms of the measure numbers, for example, from the 11th measure through 14th measure. The second one is that the start time point and the end time point are individually designed by manipulating the allotted controls such as a start designating switch and an end designating switch provided in the waveform data processing apparatus of the present invention in real time. For example, the user listens to the metronome clicking or a musical performance on another track being played back, and manipulates the switches at the respective intended time points. The third one is that the apparatus is set at the stand-by state, and records the start event when the start of the inputted waveform sample is detected and records the end event when the finish of the inputted waveform sample is detected. The start and the finish of the waveform can be detected by judging the waveform level increasingly crossing over the predetermined threshold and decreasingly crossing over the predetermined threshold, respectively, or by judging the slope (gradient) of the envelope of the waveform crossing over the predetermined value, or by other conventional methods.

The waveform samples can be inputted by various ways. Such ways include a method in which analog waveform signals are inputted through the analog input interface AD, a method in which digital waveform signals are inputted through the digital input interface Din L/R, a method in which waveform signals are read out from an external storage device such as a CD-ROM, a method in which waveform signals are downloaded from a server computer via a network a method in which waveform signals are once recorded in the waveform data processing apparatus of the present invention and such recorded waveform signals are played back (i.e. resampled) direct or after some modification, for example, by passing through a filter or an effect circuit, or with the tempo being changed, and any other adaptable methods.

Figure 3:
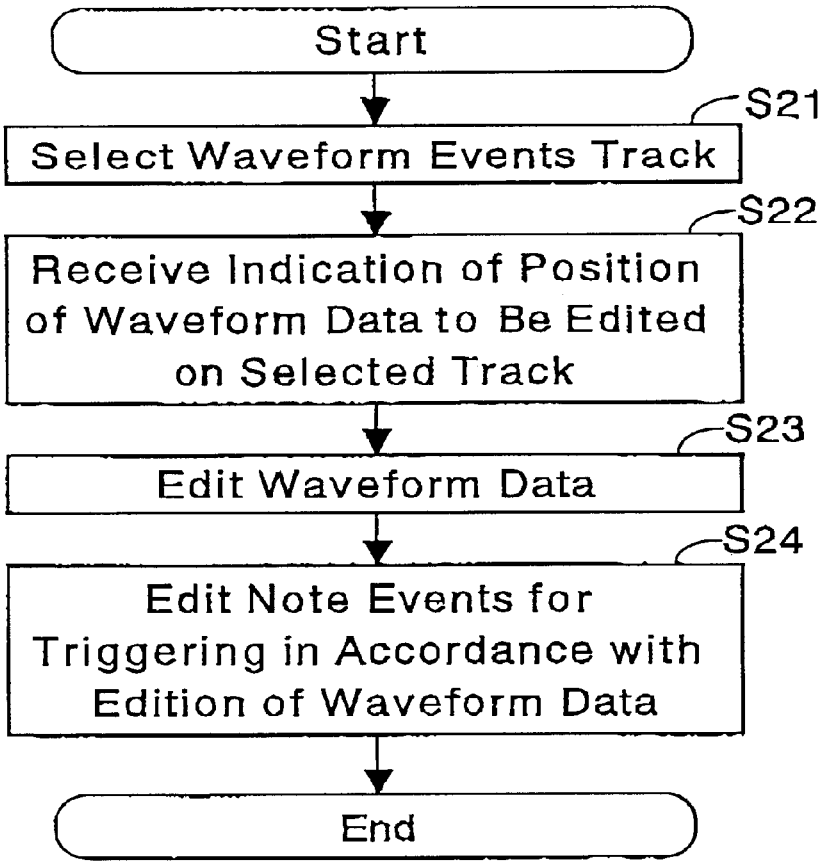
FIG. 3 is a flow chart showing the waveform edition process in an embodiment of the present invention.

FIG. 3 shows a flow chart of the waveform edition process for editing a waveform events track of a musical performance data set in an embodiment of the present invention. First at a step S21, a waveform events track of a musical performance data set is selected according to the user's input operation. A step S22 is to designate a position of the waveform data to be edited on the selected waveform events track according to the user's instruction. Then, a step S23 conducts processing of various kinds of edition of the waveform sample data. A step S24 conducts edition of the note events or the waveform events track in accordance with the edition of the waveform for triggering the corresponding waveform sample data before ending the waveform edition process.

Figure 4:
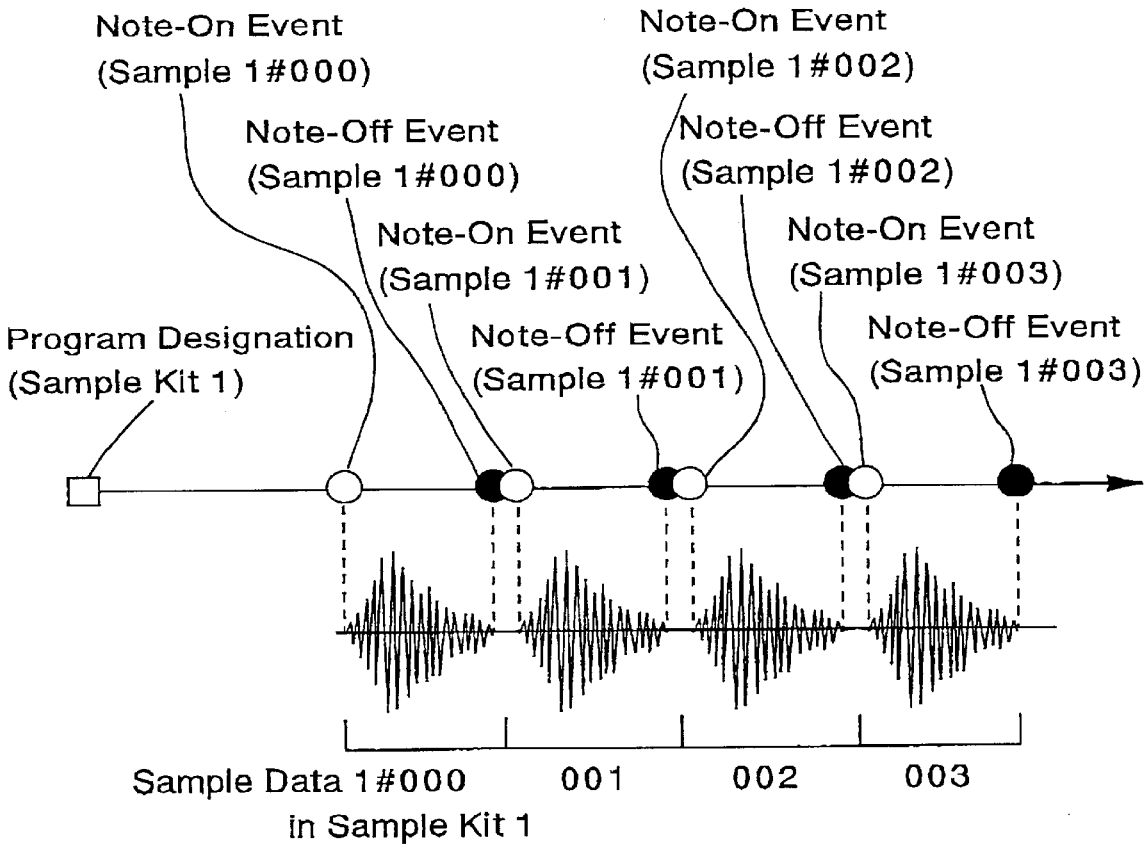
FIG. 4 is a chart showing an example of edition of the waveform and the waveform event data using a splitting function in an embodiment of the present invention.

FIG. 4 shows how the edition of the waveform data and the waveform event data is conducted using a splitting function in an embodiment of the present invention. The splitting process is a process to split or divide a waveform sample into a plurality of waveform sub-samples. Thus split waveform sub-samples are given individual identification names expressed in note numbers, respectively. In the example of FIG. 4, an original waveform sample having a note number "000" is divided into four waveform subs-samples respectively having note numbers "000" trough "003". And in association with the four sub-samples, four pairs (on and off) note events are placed on the waveform events track for triggering the respective sub-samples in the waveform sample data.

In this connection, as the split waveform sub-samples are given respective corresponding triggering events (note events) on the waveform events track a length of waveform sample representing a dram pattern containing a plurality of dram tones is once recorded in the waveform sample recording area, and then may be split into sub-samples of the respective dram tones, and thus, each of the dram tones can be played back individually in correspondence to the triggering by the allotted note event aligned on the waveform events track, which will ensure the sounding of the dram tones in a correct tempo (rhythm) in an automatic performance at various altered speed.

The splitting process of the sample data may be conducted automatically by detecting the build-up points of the waveforms or manually by the user's designation. The manual designation may be conducted by displaying a waveform chart on the display device 10 and by user-inputting the designation of splitting points along the progression of the displayed waveform. The automatically determined splitting points may be manually altered. In the case where the splitting points of the sample data are altered, the time points of the note events for triggering will be altered accordingly. The automatic splitting may be commanded (set) beforehand so that the apparatus records a waveform sample and subsequently splits the recorded waveform sample into subsamples automatically. Alternatively, the automatic splitting operation may be made selectable by the user.

Figure 5:
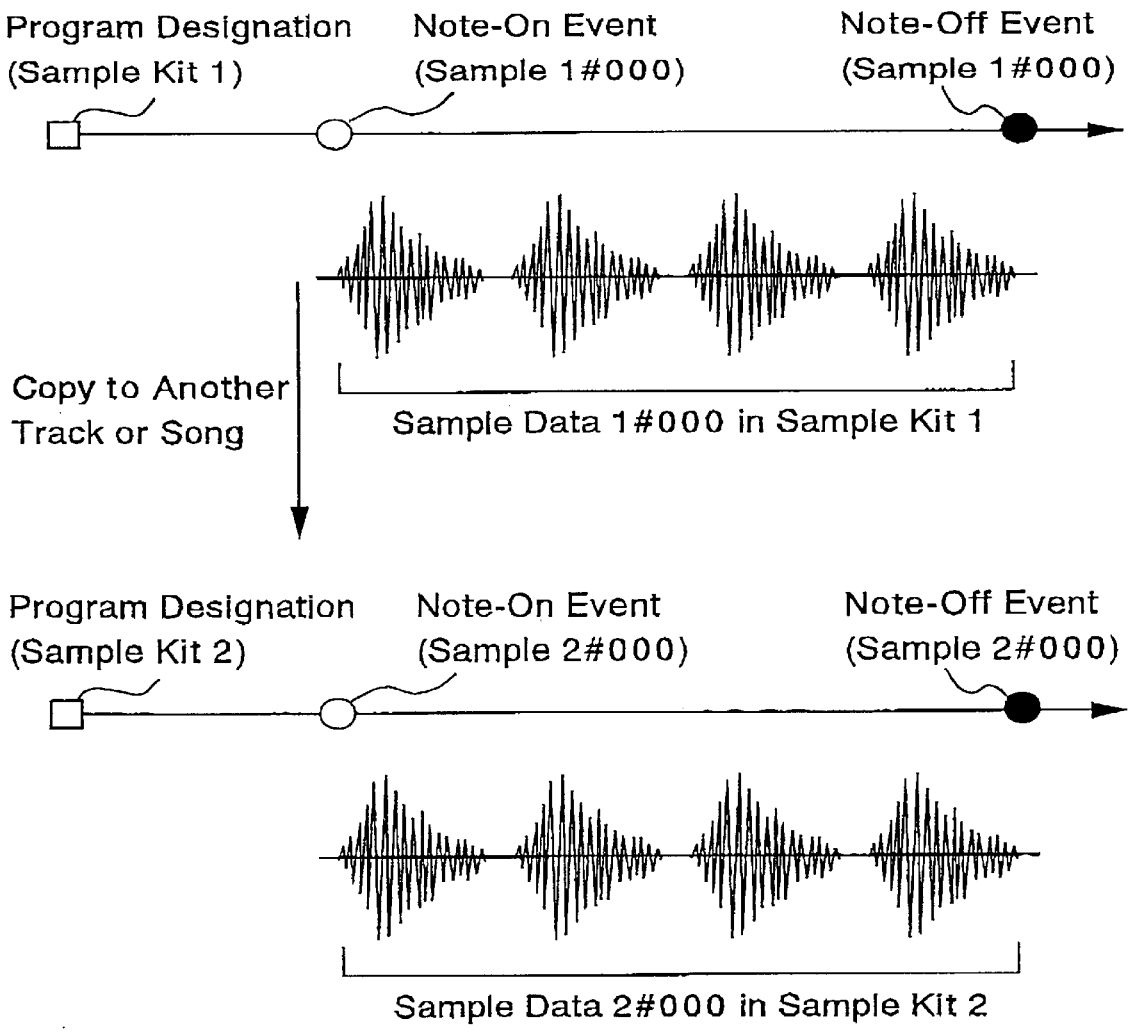
FIG. 5 is a chart showing an example of edition of the waveform data and the waveform event data using a track copy function or a song copy function in an embodiment of the present invention.

FIG. 5 shows how the edition of the waveform data and the waveform event data is conducted using a track copy, song copy function in an embodiment of the present invention. The copy process is a process to copy the already established waveform sample data and waveform events track to another track or to another musical performance data. When a new waveform sample data is created, the program designation will be automatically altered accordingly. In this way, the copy source data and the copy destination data can be separately administered. In the example of FIG. 5, waveform sample data 2#000 of a sample kit 2 is created (copied) from the waveform sample data 1#000 of the sample kit 1, and note events on the new waveform events track are named "sample 2#000". The time points of the respective new note events and the new waveform samples themselves are the same as the copy source.

Figure 6:
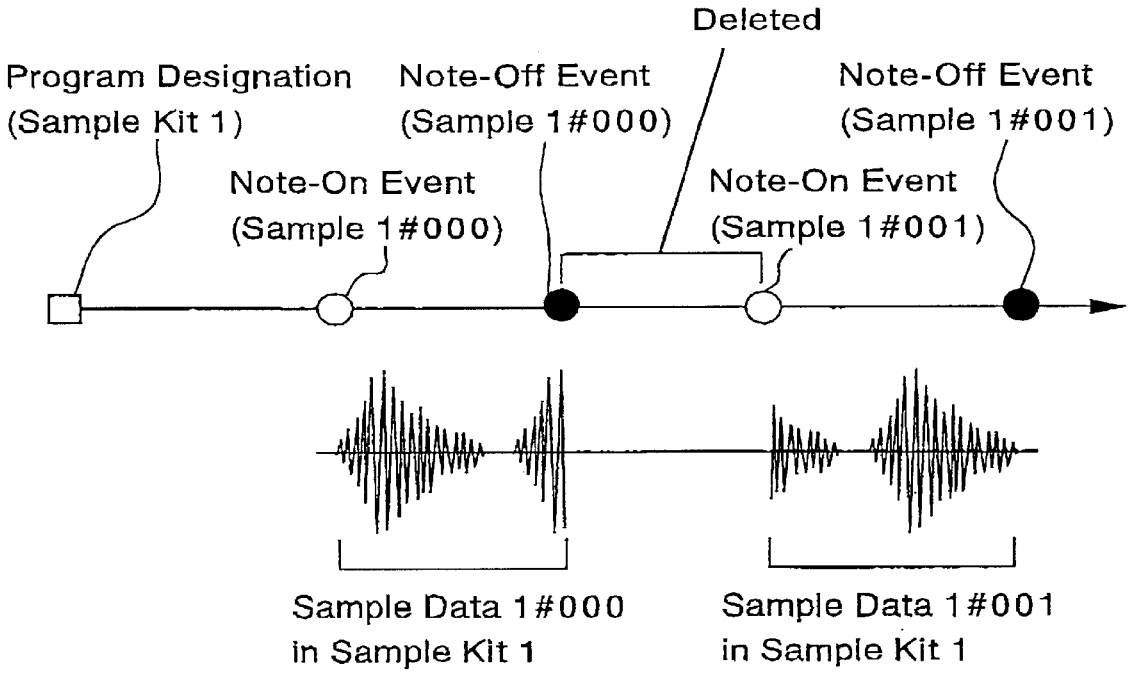
FIG. 6 is a chart showing an example of edition of the waveform data and the waveform event data using a delete function in an embodiment of the present invention.

FIG. 6 shows how the edition of the waveform data and the waveform event data is conducted using a partial delete function in an embodiment of the present invention. The partial delete function is a process to delete a part (span) of the waveform when the deletion of a partial span of the waveform existing portion of the waveform sample data is instructed, thereby dividing the original length of waveform sample into two sub-samples before and after the deleted span. The created sub-sample data are given respective sample names (note numbers). FIG. 6 shows the case where the waveform sample data and the waveform events data track of FIG. 1 are deleted partially, in which the original sample data 1#000 of the sample kit 1 are divided into a first sub-sample data block 1#000 and a second sub-sample data block #001. Further, a note-off event (sample 1#000) is created for the first sub-sample data block, and a note-on event (sample 1#001) and a note-off event (sample 1#001) are created for the second sub-sample data block. The designation of a span to be deleted may be conducted beforehand manually or may be conducted by manipulating the control switch in real time during the waveform sample data are being played back.

Types of edition may be versatile other than those described above. For example, a partial span of a waveform may be pasted to another point or span, another track, or another musical performance data. In this case, a destination for pasting may be a point or span of another waveform or may be a blank span where there is no waveform. When there exists another waveform it the intended destination spot apart of the original waveform may be cut out at the portion where a new waveform part is pasted. For example, where there is a waveform span of 11th through 14 measures and another waveform fraction is pasted to the 12th measure, the resultant waveform data now consists of an 11th measure portion, a twelfth measure portion and a 13th–14th measure portion i.e. three portions in number. Note events are also added in the waveform events track for triggering the thus produced three portions.

Alternatively, a waveform may be trimmed, for example, by cutting out the unnecessary portions before and/for after the recorded waveform span. In this case also, the positions of the note events will be adjusted accordingly.

Further, a loop start point and a loop end point may be set in the waveform sample data so that the waveform fraction between these two points will be played back more than one times in loop. In this case, the span between the note-on event and the note-off event on the waveform events track is set longer than the length of the loop span of the waveform sample data so that the span for loop use will be played back repeatedly until the note-off event comes.

Further, the above split waveform sub-samples and the corresponding note events for triggering may be adjusted or shifted in location afterward. For example, the time points may be adjusted by quantization or by intentional shifting from the correct timing.

Although the above description has been made with respect to an embodiment in which a hard disk recorder is employed for the waveform data processing apparatus, the invention may not be limited to such a type of apparatus, but can be also realized with other types of apparatus such as an electronic musical instrument, and a personal computer with an application software, and further a karaoke apparatus, a game machine, a cellphone terminal or other portable communication terminal unit, and a player piano. In the case where the invention is applied to a communication terminal unit, the whole necessary functions may be incorporated in the terminal unit, or part of those functions may be equipped in the server machine so that the overall processing will be performed as a system comprising a terminal unit and a server machine.

Where the apparatus takes the form of an electronic musical instrument, the form may not necessarily be limited to the form of a keyboard type instrument, but may be of a string instrument type, a wind instrument type, a percussion instrument type, or else. Further, the external storage device such as a hard disk, the tone generator, the automatic musical performance device may not necessarily be incorporated in the console of an electronic musical instrument, but may be separate apparatuses connected together by means of communication lines such as MIDI cables and various networks.

The program for the processing and various data pieces or sets (a musical performance data set and/or waveform sample data blocks) to be used in the processing may be supplied by an external storage medium or from an external source via a communication interface to an electronic musical instrument or a personal computer. A communication interface and a communication network may be a cabled type or may be a wireless types or a hybrid type of the both.

In the above embodiment the data format for the musical performance data (events track) is of an "absolute time+event" type which represents the time point of an event (note-on event, note-off event) by an absolute time point in the music piece. But it should be understood that the data format is not necessarily be limited to such a type, but may be of any other type such as a "relative time+event" type which represent the time point of an event by a time lapse from the preceding event (expressed in clock count), a "note event+duration" type which represents a note on event and the length between the note-on event and the note-off event as a duration of the event, and a "direct memory mapping" type in which memory regions are secured (allotted) for all the available time points under the minimum resolution (clock period) of time progression for the music and each event is written at a memory region which is allotted to the time point for such each event.

The musical performance data may be processed in various ways. Examples ara: a method in which the processing period (rate) is altered according to the tempo set for the music progression to be processed a method in which the values of the time point data pieces in the musical performance data set are changed in accordance with the tempo set for the musical progression to be processed with the processing period being kept unchanged, a method in which the counting rate for the time point data in the musical performance data set to be processed in every processing is altered in accordance with the tempo set for the musical progression to be processed with the processing period being kept unchanged, and so forth. In any method, the note events recorded on the waveform events track for triggering the waveform samples ensures the correct timing for playing back the waveform samples.

The time-serial musical performance data string may be stored in constructive areas on the memory, or may be stored in scattered areas with a specific data administration to handle as consecutive data. The point is that the performance data should only be handled as a time-serial consecutive data and should not necessarily be stored in series on the memory.

While the control program is stored in the flash memory 2 in the case of the above-described embodiment, the program may be stored in external storage device such as a hard disk a floppy disk, a CD-ROM and an MO disk. If, for example, the control program is stored its a CD-ROM, and then the control program is read out from the CD-ROM to store in the hard disk, which in turn is stored in the RAM 3, so that the CPU 1 can operate in the same fashion as the case where the control program is stored in the flash memory 2. The above will be convenient for newly installing the control program and for upgrading or addition of the control program. Where the control program is stored in a floppy disk, an MO disk, or else, the control program may be supplied therefrom to the RAM 3 or the hard disk 7. Also, the control program in the flash memory 2 may be rewritten for upgrading.

The control program may be downloaded through a communication interface. In this case, the waveform processing apparatus is connected to a communication network such as a LAN (local area network), Internet and a telephone line to receive a delivery of the control program or a song data set or a performance data set from a server computer and record the same in the hard disk. Thus the downloading operation is accomplished. In this connection, the communication interface may be a dedicated MIDI interface, and also may be a general purpose interface such as an RS-2332C, a USB (universal serial bus) and an IEEE1394 to constitute a MIDI interface.

As will be understood from the above detailed description, the present invention provides a waveform data processing apparatus which facilitates the constitution of a musical performance data string utilizing waveform sample, which will be convenient in handling waveform data for an automatic musical performance. Further, the present invention provides a waveform data processing apparatus which enables an automatic musical performance using waveform samples at a correct intended tempo, even when the tempo of the playback may be arbitrarily altered. Still further, the present invention provides a waveform data processing apparatus which permits an easy edition of the musical performance using recorded waveform samples, just like in the case of tape splicing for the tape recorder.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. A waveform data processing apparatus for constituting a musical performance data string, comprising:

a waveform data recording device which records waveform data representing waveform samples; and a waveform events track recording device which records, on a waveform events track defining a musical progression with respect to time, waveform event data representing events for employing waveform samples to constitute a musical performance;

said waveform event data including trigger signals at time points where respectively corresponding ones of said waveform samples are to be employed along said musical progression on said waveform events track for constituting said musical performance, said trigger signals serving to trigger the playback of said waveform samples recorded in said waveform recording device in accordance with reading out said waveform events track.

2. A waveform data processing apparatus according to claim 1, further comprising a data edition device which edits said trigger signals in said waveform event data correspondingly with said waveform data in response to an edit instruction for said waveform event track.

3. A waveform data processing apparatus according to claim 1, wherein said musical progression on said waveform events track is constituted by a series of measures, each measure being identified by a measure number, and wherein said waveform events track recording device records, on said waveform events track, events of triggering the start and the end of each said waveform sample, at least one of the start triggering event and the end triggering event being recorded at a time point as determined previously in terms of a measure number.

4. A waveform data processing apparatus according to claim 1, further comprising a manipulating control device for inputting in real time a designation of a time point for recorded an event, and wherein said waveform events track recording device records, on said waveform events track, events of triggering the start and the end of each said waveform sample, at least one of the start triggering event and the end triggering event being recorded at the time point as designated by said designation inputted by said manipulating control in real time.

5. A waveform data processing apparatus according to claim 1, further comprising a waveform sample inputting device for inputting a waveform sample to be recorded as said waveform data by said waveform data recording device and a waveform start and/or end detecting device for detecting the start and/or the end of said inputted waveform sample, and wherein said waveform events track recording device records, on said waveform events track, events of triggering the start and the end of each said waveform sample, at least one of the start triggering event and the end triggering event being recorded at the time point when said start and/or said end are detected.

6. A waveform data processing apparatus according to claim 1, wherein said waveform data is given an identification name, and wherein said waveform events track recording device records a program designation event indicating said identification name at a position prior to the first waveform event on the waveform events track.

7. A waveform data processing apparatus for constituting a musical performance data string, comprising:

a waveform data recording device which records waveform data representing waveform samples, each having a length and defining at least one musical tones, each tone having a build-up point;

a waveform events track recording device which records, on a waveform events track defining a musical progression with respect to time, waveform event data representing events for employing said waveform samples to constitute a musical performance; and a waveform data splitting device which detects at least one of said build-up points and splits said waveform data at said detected build-up point into waveform sub-samples;

said waveform event data including trigger signals at time points where respectively corresponding ones of said waveform samples and sub-samples are to be employed along said musical progression on said waveform events track for constituting said musical performance, said trigger signals serving to trigger the playback of said waveform samples and sub-samples recorded in said waveform recording device in accordance with reading out said waveform events track.

8. A waveform data processing apparatus according to claim 7, further comprising a data edition device which edits said trigger signals in said waveform event data correspondingly with said waveform data in response to an edit instruction for said waveform event track.

9. A waveform data processing apparatus according to claim 7, wherein said musical progression on said waveform events track is constituted by a series of measures, each measure being identified by a measure number, and wherein said waveform events track recording device records, on said waveform events track, events of triggering the start and the end of each said waveform sample, at least one of the start triggering event and the end triggering event being recorded at a time point as determined previously in terms of a measure number.

10. A waveform data processing apparatus according to claim 7, further comprising a manipulating control device for inputting in real time a designation of a time point for recording an event, and wherein said waveform events track recording device records, on said waveform events track, events of triggering the start and the end of each said waveform sample, at least one of the start triggering event and the end triggering event being recorded at the time point as designated by said designation inputted by said manipulating control in real time.

11. A waveform data processing apparatus according to claim 7, further comprising a waveform sample inputting device for inputting a waveform sample to be recorded as said waveform data by said waveform data recording device and a waveform start and/or end detecting device for detecting the start and/or the end of said inputted waveform sample, and wherein said waveform events track recording device records, on said waveform events track, events of triggering the start and the end of each said waveform sample, at least one of the start triggering event and the end triggering event being recorded at the time point when said start and/or said end are detected.

12. A waveform data processing apparatus according to claim 7, wherein said waveform data is given an identification name, and wherein said waveform events track recording device records a program designation event indicating said identification name at a position prior to the first waveform event on the waveform events track.

13. A waveform data processing apparatus according to claim 7, wherein said split waveform sub-samples are given individually identifying names and said trigger signals are respectively identified corresponding to said identifying names.

14. A method for processing a waveform data to constitute a musical performance data string, said method comprising:

a step of recording waveform data representing waveform samples; and a step of recording, on a waveform events track defining a musical progression with respect to time, waveform event data representing events for employing waveform samples to constitute a musical performance;

said waveform event data including trigger signals at time points where respectively corresponding ones of said waveform samples are to be employed along said musical progression on said waveform events track for constituting said musical performance, said trigger signals serving to trigger the playback of said waveform samples recorded in said waveform recording device in accordance with reading out said waveform events track.

15. A method for processing a waveform data according to claim 14, further comprising a step of editing said trigger signals in said waveform event data correspondingly with said waveform data in response to an edit instruction for said waveform event track.

16. A method for processing a waveform data to constitute a musical performance data string, said method comprising:

a step of recording waveform data representing waveform samples; each having a length and defining at least one musical tones, each tone having a build-up point;

a step of recording, on a waveform events track defining a musical progression with respect to time, waveform event data representing events for employing said waveform samples to constitute a musical performance;

a step of detecting at least one of said build-up points; and a step of splitting said waveform data at said detected build-up point into waveform sub-samples;

said waveform event data including trigger signals at time points where respectively corresponding ones of said waveform samples and sub-samples are to be employed along said musical progression on said waveform events track for constituting said musical performance, said trigger signals serving to trigger the playback of said waveform samples and sub-samples recorded in said waveform recording device in accordance with reading out said waveform events track.

17. A method for processing a waveform data according to claim 16, further comprising a step of editing said trigger signals in said waveform event data correspondingly with said waveform data in response to an edit instruction for said waveform event track.

18. A machine readable medium for use in a waveform data processing apparatus comprising a computer, said medium containing program instructions executable by said computer for executing:

a process of recording waveform data representing waveform samples; and a process of recording, on a waveform events track defining a musical progression with respect to time, waveform event data representing events for employing waveform samples to constitute a musical performance;

said waveform event data including trigger signals at time points where respectively corresponding ones of said waveform samples are to be employed along said musical progression on sad waveform events track for constituting said musical performance, said trigger signals serving to trigger the playback of said waveform samples recorded in said waveform recording device in accordance with reading out said waveform events track.

* * * * *